United States Patent [19]

Finn et al.

[11] 4,163,353

[45] Aug. 7, 1979

[54] METHOD OF PACKAGING COMPRESSIBLE FIBROUS BATTS

[75] Inventors: Lawrence R. Finn, Toledo; Daniel A. McCartan, Heath, both of Ohio; Gary M. Schmandt, Bellevue, Wash.

[73] Assignee: Owens-Corning Fiberglas Corporation, Toledo, Ohio

[21] Appl. No.: 877,140

[22] Filed: Feb. 13, 1978

Related U.S. Application Data

[60] Division of Ser. No. 755,370, Dec. 29, 1976, Pat. No. 4,085,560, which is a continuation of Ser. No. 585,161, Jun. 9, 1975, abandoned.

[51] Int. Cl.[2] ..... B65B 63/02; B65B 63/04

[52] U.S. Cl. ..... 53/430; 53/435; 53/436

[58] Field of Search ..... 53/21 FW, 23, 24, 118

[56] References Cited

U.S. PATENT DOCUMENTS 3,133,386 5/1964 Johnston ..... 53/118 X

*Primary Examiner*—Travis S. McGehee

*Attorney, Agent, or Firm*—John W. Overman; Charles F. Schroeder; Allen D. Gutchess, Jr.

[57] ABSTRACT

A method and apparatus for packaging compressible fibrous batts and a package of same are provided. The batts are formed by severing a longitudinally-extending strip of compressible fibrous material into batts of discrete lengths with the batts then being collected in end-to-end relationship. The batts are then moved into a loop of a packaging machine, which loop is formed by a belt maintained under controlled tension. The batts are fed longitudinally in abutting, end-to-end relationship into the belt loop which places them under compression as they are wound into a package, with the loop gradually expanding in diameter as the package size increases. Tapes are placed directly around the outermost batt to hold the package in the compressed state and the completed package is then discharged from the machine.

8 Claims, 10 Drawing Figures

METHOD OF PACKAGING COMPRESSIBLE FIBROUS BATTS

This is a division of application Ser. No. 755,370, filed Dec. 29, 1976, now U.S. Pat. No. 4,085,560 which is a continuation of Ser. No. 585,161, filed June 9, 1975 now abandoned.

This invention relates to a method and apparatus for packaging compressible fibrous batts and to a package of same.

Building insulation, particularly for walls, is often supplied in precut widths and lengths. Thus, the insulation is in the form of batts which are of a width equal to the spacing between studs of a wall and are of a length equal to the length of the studs. The batts are often slightly oversized in width so that they may be pressed in place between the studs and held by friction. Otherwise, the batts can have backing sheets adhered to one surface, extending beyond the edges, and fastened to the studs to serve as a vapor barrier. In either case, batts heretofore have been supplied in a compressed package in which they are highly compressed in thickness but not in length, with the length of the package equaling the length of the batts.

The instant invention provides a package of batts which are wound and compressed in a spiral configuration in end-to-end relationship with the final package of eight or nine batts, by way of example, having about the size and shape of a conventional long strip of insulation packaged in spiral form. A package of this shape is easier to handle and to store than the batt packages heretofore known. The batts in the spiral configuration can be held in their compressed state by tapes applied directly to the outer surface of the outermost batt, without any paper overwrap on the batt whatsoever, as has heretofore been the usual practice with a single elongate strip of insulation wound in spiral form. This eliminates the cost of the paper overwrap as well as the problem of disposing of it at the installation site.

In the method and apparatus for forming the package of batts, a fibrous insulating strip of indeterminate length is first formed and then severed to form the batts of determinate lengths as the strip moves longitudinally along a conveyor. After severing, the batts are moved onto a faster conveyor and are separated by a substantial distance but still maintain their longitudinal relationship with respect to the conveyor. The batts are then sequentially stopped on the conveyor, which continues to move and slide under them, by means of a plurality of gates. In the preferred form, the gates squeeze the batts from the side edges to prevent them from moving and to retain them in selected positions relative to the conveyor. At this time, the batts are in close, but spaced, end-to-end relationship. After a predetermined number of the batts are collected, the gates are then opened in reverse order to enable the batts to move into abutting, end-to-end relationship and then move as a unit to a packaging machine. The packaging machine has a belt forming a loop into which the batts are longitudinally fed. The belt is under tension to place the batts in compression as they are wound in a spiral configuration, with the size of the loop increasing as the number of batts fed into it increases. When the predetermined number of batts are spirally wound, tape is placed around the outer surface of the outermost batt to maintain the batts in their compressed state in the package, at which time the package is discharged from the machine.

It is, therefore, a principal object of the invention to provide a package of compressed insulating batts which has a shorter maximum dimension than packages of batts heretofore known.

Another object of the invention is to provide a package of insulating batts wound in a spiral configuration with tapes holding the batts in a compressed state without any overwrap between the insulation and the tape.

A further object of the invention is to provide a method of collecting compressed batts in end-to-end relationship prior to subsequent processing of them.

Still another object of the invention is to provide a method of collecting batts in abutting, end-to-end relationship and winding them into a spiral configuration while maintaining that relationship.

Still a further object of the invention is to provide apparatus for collecting batts for subsequent packaging into a spiral package which is easier to store and handle.

Yet another object of the invention is to provide improved apparatus for collecting insulating batts for subsequently forming into a spiral package in which the batts are in end-to-end relationship.

Many other objects and advantages of the invention will be apparent from the following detailed description of preferred embodiments thereof, reference being made to the accompanying drawings, in which.

Figures 1, 2, 3, 4:
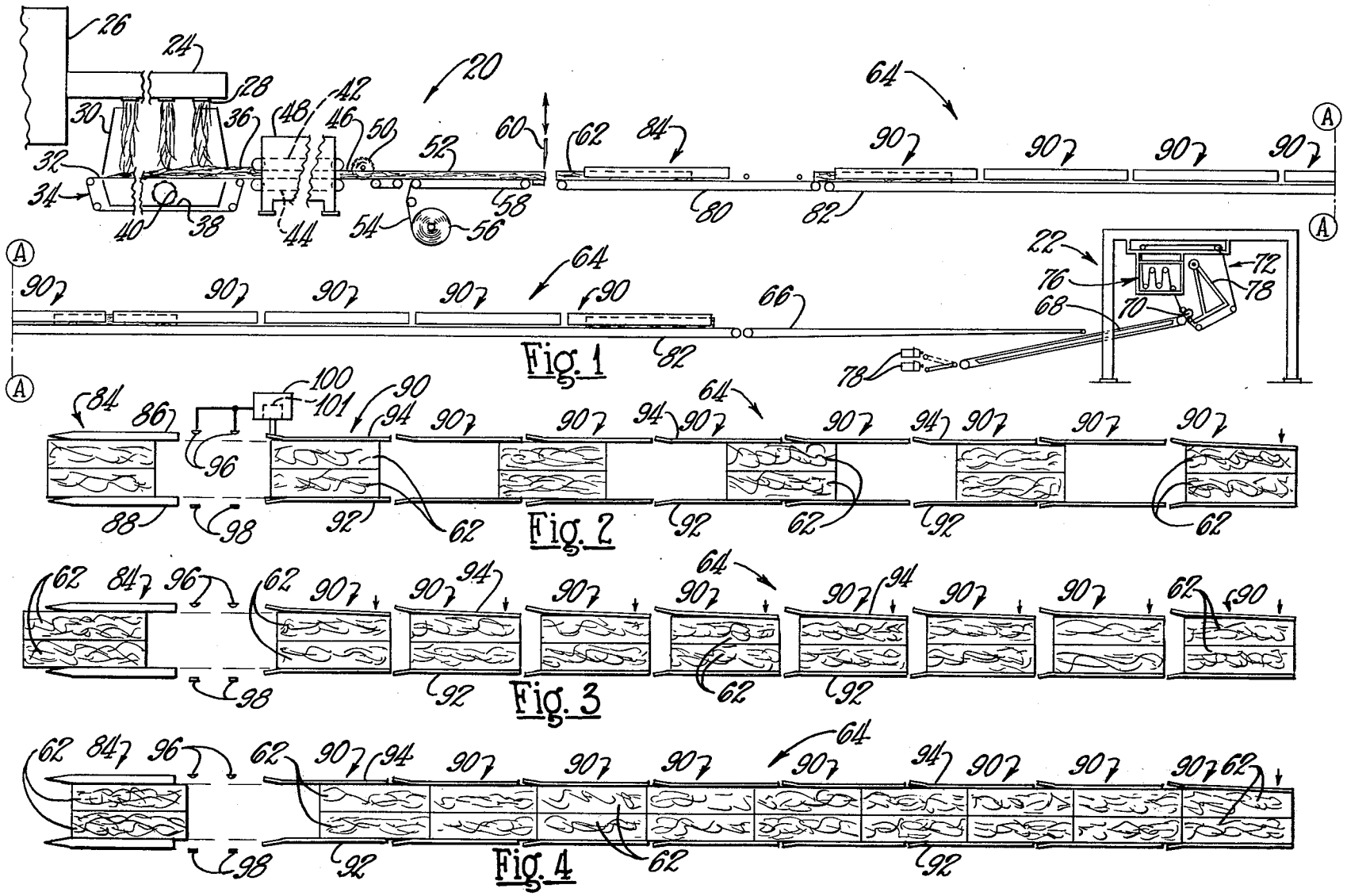
FIG. 1 is a schematic side view in elevation of apparatus for forming strips of insulating material of indeterminate lengths, for severing the strips into batts of determinate lengths, for collecting the batts in end-to-end relationbship, and for spirally winding the batts into a package.
FIGS. 2–4 are schematic plan views of the apparatus of FIG. 1 for retaining and collecting the batts and for feeding them toward the packaging machine in abutting, end-to-end relationship.

Referring to FIG. 1, a production line on which a compressible fibrous strip, specifically building insulation, can be produced is indicated at 20. Packaging apparatus for packaging compressible fibrous batts of the compressible strip, after being severed, is indicated at 22. The production line 20 is of a substantially known design and construction and will be discussed only briefly. A forehearth 24 receives heat-softened glass or other flowable, fiber-forming material from a melting furnace 26 in which raw batch material is reduced to a flowable or molten state. The molten glass is fed to fiber-forming units 28 located beneath the forehearth 24, from which glass fibers are formed. By way of example, each of the units 28 can be a hollow, rotatable member or spinner having orifices in the periphery through which molten glass is attenuated into primary fibers. The primary fibers are then further attenuated and directed downwardly by hot gaseous blasts from blowers or burners (not shown) located around the units 28. The fibers so formed are moved downwardly through a forming hood 30 and are sprayed with binder by suitable spray devices (not shown) which direct the binder into the forming hood transversely of the path of the fibers.

The sprayed fibers are then randomly disposed on an upper flight 32 of a foraminous, endless belt conveyor 34, the fibers being collected as a mass or layer 36 of an approximate desired thickness. The layer 36 of fibers is carried along the along the conveyor 34 while a suction chamber 38, located below the upper flight 32 of the conveyor, holds the fibers on the flight 32 by means of suction provided by an exhaust conduit 40 connected to a suction blower (not shown). The suction also assists in carrying away the spent gases of the attenuating blasts and also organic particles from the binder.

The layer 36 of the fibers is then advanced to a region between upper and lower foraminous belts 42 and 44 which are positioned so as to compress the fibers somewhat into a fibrous layer or body 46 of a given thickness. The foraminous belts 42 and 44 convey the fibrous layer through an oven or heating chamber 48 in which the binder is set or partially cured on the fibers at a temperature in the order of 450°–500° F. When the layer 46 emerges from the oven 48, the edges are trimmed by rotatable knives 50 which remove uneven edge strips from the layer 46 and, in this instance, a center one of the rotatable knives severs the formed layer 46 into two narrower fibrous layers 52. A plurality of the rotatable knives can be used to form a plurality of the layers or lanes 52 in side-by-side relationship, if desired. A plow (not shown) can be used to spread apart the layers 52 slightly. At this time, a coated kraft paper or similar backing sheet 54 can be applied to the lower surface of each of the layers 52, the sheets being fed upwardly underneath the layers. The sheets can have an adhesive suitably applied to the upper surfaces thereof prior to being fed into contact with the layers, to provide adhesion therebetween. The backing sheets 54 can be supplied from suitable reels 56 located below a belt conveyor 58 over which the sheets 54 are directed.

The layers 52, with or without the backing sheets 54, are then carried along the conveyor 58 and under a cut-off or severing knife 60 which cuts the layers 52 into batts 62 of determinate lengths. The width of the batts 62, as determined by the rotatable knives 50, are such as to fit between the studs of a building. The widths can be slightly more than the spacing between the studs so that the batts can fit snugly therebetween and held by friction. Where the backing sheet 54 is employed, the edges of the sheet beyond the edges of the compressible fibrous layer 52 are fastened to the studs so that the backing sheet can serve as a vapor barrier. In either case, the length of the batts 62, as determined by the cut-off knife 60, is substantially equal to the length of the studs so as to fill the entire space between the studs.

Heretofore, the batts 62 have been removed from the line downstream of the cut-off knife 60 and packaged in a packaging machine which compresses the batts, laid in superimposed relationship to a depth of six feet, for example, to a highly compressed state. However, the length of the batts is not changed so that the resulting package is as long as the batts originally were. This renders the packages cumbersome and difficult to handle and also presents a storage and transportation problem in many instances.

In accordance with the invention, the batts are packaged in spiral, end-to-end relationship so as to form an overall cylindrical package which is much easier to handle and manipulate. In order to accomplish this, the line is provided with retaining and collecting apparatus or an accumulator generally indicated at 64 which retains and collects the batts 62 and then feeds them in abutting, end-to-end relationship to the package machine 22. The retaining and collecting apparatus 64 will be discussed more fully subsequently.

After this apparatus, the batts are then carried by a supply conveyor 66 to an inclined, suction conveyor 68 and into a loop 70 formed in an endless belt 72 carried by a main frame 74 of the machine 22. The belt 72 is suitably driven in a general clockwise direction as viewed in FIG. 1 and is maintained under controlled tension by tensioning means indicated at 76. As the batts 62 are fed up the inclined conveyor 68 and into the loop 70, they are rotated in a counterclockwise direction into a spiral configuration and are compressed by virtue of the tension on the belt 72. As the batts continue to feed into the loop 70, however, the loop size increases while still maintaining compression on the batts. As the last of the batts in the series being packaged are fed toward the machine 22, tapes are dispensed from tape dispensing devices 78 located below the conveyor 66 and are fed up the inclined conveyor 68 and into the loop 70 around the outermost batt in each of the packages. The batts are then held in their compressed state by the tapes. With the packages completed, an inner framework 78 of the machine 22 pivots in a counterclockwise direction to open or straighten the loop 70 and discharge the completed packages of batts therefrom.

A packaging machine of this type is disclosed more fully in a U.S. patent application of Miller et al, Ser. No. 500,795, and will not be discussed in more detail.

Because time is required between the completion and discharge of packages in the loop 70 and the readjustment of the belt 72 to receive new series of batts in the loop 70, the speed of the belt 72 must be in excess of the speed of the conveyors 34 and 58. Since the speed of the belt 72 exceeds the speed of the conveyors 34 and 58, the problem of retaining and collecting the batts 62 in abutting, or at least close, end-to-end relationships is greater than it would be if the packaging machine could operate at a speed lower than that of the conveyors 34 and 58. It is also desirable for the speed of the belt 72 to slightly exceed the speed of the inclined conveyor 68 and to exceed the speed of the supply conveyor 66. This provides a certain controlled slippage between the belts and the batts being packaged which prevents the possibility of buckling of the batts in the loop 70.

The retaining and collecting apparatus 64 will now be discussed in more detail. The apparatus includes first and second belt conveyors 80 and 82 which can be all one conveyor or, in actual practice, divided into several shorter conveyors. The apparatus also includes a set 84 of stationary guides 86 and 88 (FIGS. 2–4) and a plurality of gates 90, there being eight of the gates 90 in this instance. Each of the gates 90 includes a stationary side guide or elongate member 92 (FIGS. 2–5) and a movable side guide or elongate member 94. The movement of the movable guides 94 is controlled by electric eyes 96 and reflectors 98, two being employed to prevent accidental triggering of the system by a short batt or a piece of extraneous wool moving along the conveyor 80. The electric eyes initiate operation of a counter assembly 100 which sequentially moves the movable guides 94 inwardly to close each of the gates 90, starting at the downstream end, to retain the batts 62 as they enter the respective gates. It is not essential to provide a gate for each set of batts. However, if more than two sets of batts are attempted to be retained by one gate, the upstream batts tend to bounce over the other batts or the batts tend to buckle due to the speed of the conveyor 82.

As the batts 62 move along the retaining and collecting apparatus, downstream of the cut-off blade 60, they are rather widely spaced apart, by a distance of six to twelve feet, for example, because the conveyors 80 and 82 are operated at a substantially higher speed, typically from 1.6 to 2.0 times the speed of the conveyors 34 and 58, and substantially equal to the speed of the belt 72. This distance is shown in FIG. 2 where the first set of the batts 62 has been retained by the most downstream gate 90 with the other following along at spaced intervals. The timing of the movable gates 94 by the counter assembly 100 is such that the second set of the batts 62 is still upstream of the second of the gates 90 when the movable gate 94 thereof is closed, and so on up the line.

FIGS. 2–4 show the gates accumulating two lanes of articles or batts, and specifically nine per package. FIG. 3 shows each of the gates retaining a set of two of the side-by-side batts 62 with the ninth set of batts moving between the guides 86 and 88. When these last two batts 62 move between the electric eyes 96 and the reflectors 98, the counter assembly 100 will begin to open the movable guides 94 for the gates 90 sequentially, but in a downstream direction, in this instance. The control of the opening of the gates is designed so that the movable guide 94 of the downstream gate 90 opens as the trailing eight sets of the batts 62 are in abutting relationship, as shown in FIG. 4. At this time, when the last gate opens, the nine sets of the batts 62 move as a unit downstream over the conveyor 66 and up the inclined conveyor 68 and into the loop 70 of the belt 72. With the belt 72 operating slightly faster than the conveyor 68, a slight but insignificant gap will exist between the batts as they enter the loop 70. If the belt 72 is at a slightly slower speed than the conveyor 68, the ends of the abutting batts will be slightly compressed as they enter the loop 70.

The counter assembly 100 can actually include eight commercially-available counters, ones for each of the gates 90. When the electric eyes 96 are blocked by the first set of the batts 62, they energize a first counter which closes the first or downstream one of the gates 90 after a predetermined number of pulses are counted. The pulses emanate from a magnetic pickup 101 which is coordinated with the speed of the conveyor 82. The second set of the batts 62 energize the electric eyes 96 again which energize a second one of the counters. This one causes the second gate 90 to close after a predetermined number of pulses which is less than the number set for the first counter. This operation continues until the eighth counter causes the eighth one of the gates 90 to close after a short number of pulses. The ninth set of the batts 62 causes the electric eyes 96 to energize a ninth counter which opens the eighth of the gates 90 after a predetermined number of pulses and initiates a tenth counter which sequentially opens the seventh through the first of the gates 90 after a constant, short number of pulses, the tenth counter resetting and repeating until all of the gates are opened. By this time, a tenth set of batts, the first set for the next packages, will energize the electric eyes 96 to initiate operation of the first counter again to close the first set of the gates 90 after the predetermined number of pulses.

Rather than employing the pulses, timers can be used. However, the counter and pulse arrangement negates the necessity for resetting the controls when the speed of the conveyor 82 is changed, as is necessary with timers. In addition, rather than the counter assembly 100, one or a pair of electric eyes can be employed at the upstream end of each of the gates 90. The electric eyes 96 in that instance cause the first of the gates 90 to close. When the batts block the electric eye or eyes at the upstream end of that gate, the second of the gates 90 is closed, and the electric eye circuitry at the upstream end of that gate is energized. When the second of the gates 90 retains the second set of the batts 62, the electric eye or eyes at the upstream end thereof close the third of the gates and energize its electric eye circuitry. The counter assembly 100, however, has one principal advantage over the electric eyes in that the assembly requires less maintenance since the electric eyes require fairly frequent cleaning.

Figure 5:
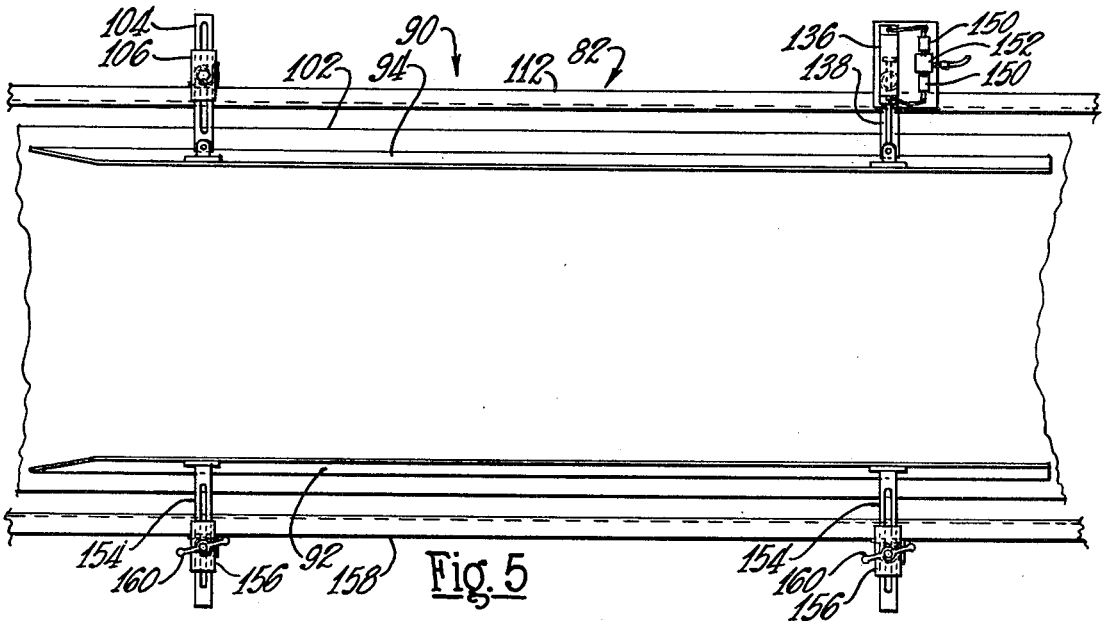
FIG. 5 is a fragmentary plan view of one of a number of pairs of gates of the apparatus of FIGS. 2–4.
Figure 6:
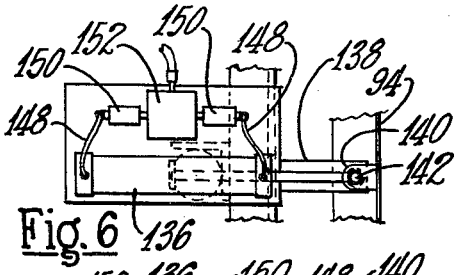
FIG. 6 is a fragmentary plan view of apparatus for moving one end of a movable gate of the pair shown in FIG. 5.
Figure 8:
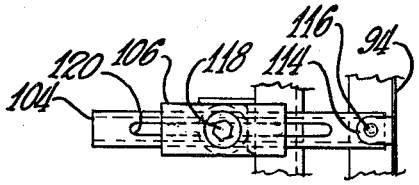
FIG. 8 is a plan view of apparatus for supporting the other end of the movable gate of FIG. 5.
Figure 7:
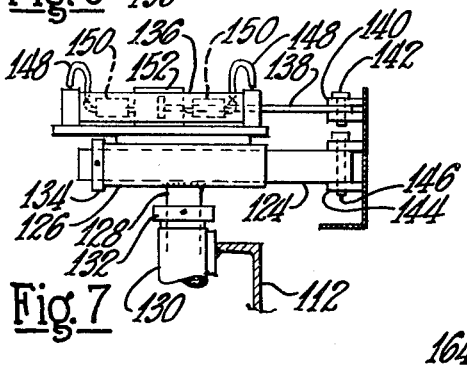
FIG. 7 is a fragmentary side view in elevation of the apparatus of FIG. 6.
Figure 9:
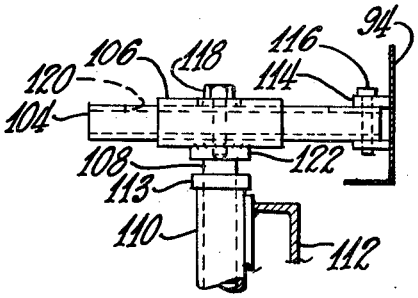
FIG. 9 is a side view in elevation of the apparatus of FIG. 8.

Referring in more detail to the guides and to FIGS. 5, 8, and 9, the upstream end of the movable guide 94 of each of the gates 90 is pivotally supported above a belt 102 of the conveyor 82 by a slotted arm 104 which extends through a horizontal sleeve 106. The sleeve 106 is affixed to an upright post 108 which is rotatably supported in a vertical sleeve 110 which, in turn, is affixed to a frame member 112 of the conveyor 82. The vertical position of the sleeve 106 and the guide 94 can be adjusted by a stop collar 113 mounted on the post 108 and bearing on the upper end of the vertical sleeve 110. The arm 104 is pivotally connected by ears 114 and a pin 116 to the guide 94. A machine screw 118 extends through a slot 120 of the arm 104 and threads into a block 120 below the sleeve 106. The screw 118 can be loosened and tightened to move the arm 104 in and out to adjust the position of the upstream end of the guide 94 relative to the conveyor belt 102 and relative to the guide 92. However, the stationary guide 92 is usually adjusted in and out to accommodate batts of different widths.

The downstream end of the movable guide 94 is supported above the conveyor belt 102 by an arm 124 which extends through a horizontal sleeve 126 which slidably supports the arm. The sleeve 126 is mounted on an upright post 128 which is rotatably held in a vertical sleeve 130 affixed to the frame member 112 of the conveyor 82. The vertical position of the sleeve 126 and the guide 94 can be adjusted by a stop collar 132 mounted on the post 126 and bearing on the upper end of the sleeve 130. The maximum movement of the arm 124 and the guide 94 toward the stationary guide 92 is determined by an adjustable stop collar 134 mounted on the arm 124 to the rear of the sleeve 126. This also determines the angle of inclination of the guide 94 when the gate is closed and the concentration of clamping pressure on the batts 62 which are being retained.

The downstream end of the guide 94 is moved in and out by a pnuematic ram 136 which has a piston rod 138 pivotally connected to the guide 94 by ears 140 and a pin 142, the arm 142 also being pivotally connected in alignment with the pivot for the rod 138 by ears 144 and a pin 146. Fluid, and specifically air, is supplied to the ends of the ram 136 by flexible hoses 148, flow control valves 150, and a four-way solenoid valve 152. The solenoid valve 152 is operated by the counter assembly 100 while the flow control valves 150 control the speed of movement of the piston rod 138 by regulation of the exhaust air.

The stationary guides 92 can be supported above the conveyor belt 102 by slotted arms 154 which are supported in horizontal sleeves 156 suitably affixed to a conveyor frame 158. The arms 154 can be adjusted horizontally relative to the sleeves 156 by a slot and threaded rod arrangement similar to that of FIGS. 8 and 9 but with hand-tightened nuts 160 for easier adjustment. The vertical position of the guides 92 can be adjusted by a post, vertical sleeve, and stop collar arrangement similar to that of FIGS. 8 and 9.

Other means can be employed besides the horizontally-movable guides 94 to retain the batts 62. For example, arms can be positioned to swing down adjacent the conveyor belt 102 and block forward movement of the batts. Timing in this instance, however, is somewhat more critical than that for the operation of the movable guides 94 which need not necessarily engage the leading edges of the batts. In addition, rather than the single wide conveyor belt 102, a multiplicity of narrower belts can be employed below which fingers can be located. At the desired times, the fingers are raised between the gaps of the narrow belts to lift the batts at least partially off the conveyor belt and thereby retain them in position.

Figure 10:
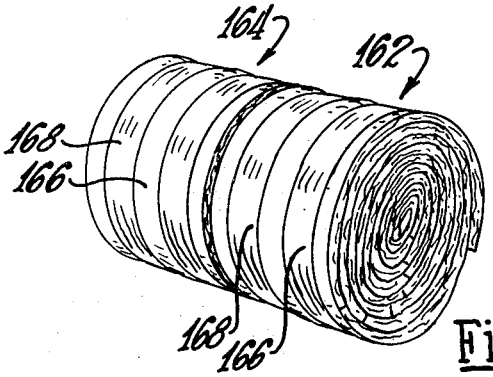
FIG. 10 is a view in perspective of packages of the batts of FIGS. 2–4 spirally wound in abutting, end-to-end relationship.

Finished packages 162 and 164 of the batts 62 are shown in FIG. 10 as they are discharged from the packaging apparatus 22. Each of the packages 162 and 164 contains nine of the batts 62 tightly wound in compressed, spiral configuration. The batts are held in their compressed state by two tapes 166 and 168 on each of the packages. The tapes preferably are from three to four inches wide and can be applied directly to the outermost one of the batts 62 without any overwrap required on the outermost batt, even if the batts do not have the backing sheet 54. Only two of the tapes 166 and 168 are required whether the batts be in the order of fifteen inches or twenty-four inches wide. The tapes preferably extend completely around the package at least once and preferably have a slight overlap. If the packages of batts are to be sold through dealers, such as lumber supply houses, a paper overwrap can be applied over the tapes and the outermost batt to provide more space for trademark and descriptive information, to protect the batts, and to improve handleability thereof.

The batts packaged are commonly in nominal eight-foot lengths which usually are either 96-inches long or 93-inches long. It is also possible to package batts of nominal four-foot lengths in which instance two sets of such batts can be retained by each gate. With the guides 92 and 94 being 10 feet long, longer batts up to approximately 10 feet in length can be packaged. The widths of the batts are commonly 15 inches, 23 inches, or 24 inches, the latter being used with thinner, steel studs. With the belt 102 being about 54 inches wide, three of the narrower batts or two of the wider ones can be manipulated and packaged in side-by-side relationship, the guides 92 being horizontally adjusted for the small variations in total width. Of course, narrower or wider conveyors can be used. Belts about 90 inches wide can convey a mix of articles, including up to five lanes of the narrower batts.

The packages of the batts can contain from four to nine batts with the number being selected by the counter assembly 100. Of course, if a larger number of the gates 90 is employed, a larger number of batts can be retained and packaged in each roll. However, packages of batts totally no more than 70–75 feet in length are preferred from the standpoint of handleability, etc. With smaller number of batts per package, the speeds of the various belts must be adjusted since there will be a greater amount of dwell time—the time between the completion of one set of packages and the receipt of the next set of batts—for a given number of batts. Hence, for small numbers of batts per package, the speed of the belt 72 and the belt 102 must be higher relative to the speed of the conveyors 34 and 58.

Various modifications of the above-described embodiments of the invention will be apparent to those skilled in the art and it is to be understood that such modifications can be made without departing from the scope of the invention, if they are within the spirit and the tenor of the accompanying claims.

We claim:

1. A method of making a package of compressible fibrous batts comprising forming a compressible elongate layer of randomly-disposed fibers held together by a binder, severing said layer into fibrous batts of determinate length, retaining and collecting said batts in spaced, end-to-end relationship by engaging side edges of said fibrous batts, and winding the batts in a spiral configuration while applying compressive forces to the outer ones of said batts as they are being wound.

2. A method of packaging batts of compressible fibrous material comprising moving a plurality of the batts longitudinally along a path, sequentially stopping said batts with ends of adjacent batts spaced apart, sequentially moving the batts into substantially abutting, end-to-end relationship, moving the batts along the path, and sequentially winding the batts into a spiral configuration while applying compressive forces transversely to the batts.

3. A method of packaging batts according to claim 2 characterized by sequentially retaining the batts with the adjacent ends spaced apart by applying compressive forces to opposite side edges of the batts.

4. A method for making a package of a plurality of articles of compressible material, said method comprising forming an elongate layer of the compressible material, severing said layer into the articles of determinate lengths, retaining and collecting said articles in spaced, end-to-end relationship by engaging side edges of said articles, releasing said articles, moving said articles in end-to-end relationship toward packaging apparatus, and packaging the articles into the package.

5. A method of making a package of compressible fibrous batts comprising forming a compressible elongate layer of randomly-disposed fibers held together by a binder, severing said layer into fibrous batts of determinate length, stopping the batts with spaces between the adjacent ends thereof, moving the batts into substantially abutting end-to-end relationship, and winding the batts in a spiral configuration while applying compressive forces to the outer ones of said batts as they are being wound.

6. A method of making a package of compressible fibrous batts comprising forming a compressible elongate layer of randomly-disposed held together by a binder, severing said layer into fibrous batts of determinate length, separating the batts to form substantial spaces between the ends thereof after the batts are severed, subsequently retaining the batts with the adjacent ends closer together but still spaced apart, subsequently moving the batts into substantially abutting, end-to-end relationship, and winding the batts in a spiral configuration while applying compressive forces to the outer ones of said batts as they are being wound.

7. A method of making a package of a plurality of articles of compressible material, said method comprising forming an elongate layer of the compressible material, severing said layer into the articles of determinate lengths, stopping the articles with spaces between adjacent ends thereof, then moving the articles into substantially abutting, end-to-end relationship, releasing the articles, moving the articles in end-to-end relationship toward packaging apparatus, and packaging the articles into the package.

8. A method of making a package of a plurality of articles of compressible material, said method comprising forming an elongate layer of the compressible material, severing said layer into the articles of determinate lengths, separating the articles to form substantial spaces between ends thereof after the articles are severed, subsequently retaining the articles with the adjacent ends closer together but still spaced apart, subsequently moving the articles into substantially abutting, end-to-end relationship, releasing the articles, moving the articles in end-to-end relationship toward packaging apparatus, and packaging the articles into the package.

* * * * *